United States Patent [19]

Marty et al.

[11] Patent Number: 4,941,596

[45] Date of Patent: Jul. 17, 1990

[54] MIXING SYSTEM FOR USE WITH CONCENTRATED LIQUIDS

[75] Inventors: John L. Marty, White Bear Lake; Philip S. Plumbo, St. Paul, both of Minn.

[73] Assignee: Minnesota Mining and Manufacturing Company, St. Paul, Minn.

[21] Appl. No.: 884,994

[22] Filed: Jul. 14, 1986

[51] Int. Cl.[5] ..... B67D 5/60

[52] U.S. Cl. ..... 222/144.5; 222/255; 222/145; 222/135; 222/148; 417/8; 137/567

[58] Field of Search ..... 134/95, 169 R; 417/7, 417/8; 137/567, 624.18, 504; 222/1, 144.5, 145, 14, 63, 72, 71, 255, 148

[56] References Cited

U.S. PATENT DOCUMENTS

| | | | |
|---|---|---|---|
| 2,424,051 | 12/1980 | Mason et al. | 417/38 |
| 2,823,833 | 2/1958 | Bauerlein | 222/129.2 |
| 2,841,176 | 7/1958 | Russ | 137/565 |
| 2,955,726 | 10/1960 | Feldman et al. | 222/76 |
| 2,965,268 | 12/1960 | Bauerlein | 222/193 |
| 3,049,266 | 8/1962 | Werry | 222/133 |
| 3,190,310 | 6/1965 | Honsinger | 137/583 |
| 3,251,508 | 5/1966 | Borys | 222/132 |
| 3,268,119 | 8/1966 | Kopera | 222/129.1 |
| 3,540,982 | 11/1970 | Sepall | 162/253 |
| 3,583,439 | 6/1971 | Dolenz et al. | 137/624.18 |
| 3,595,438 | 7/1971 | Daley et al. | 222/67 |
| 3,601,509 | 8/1971 | Kreitchman | 417/417 |
| 3,635,601 | 1/1972 | Larson et al. | 417/191 |
| 3,680,070 | 7/1972 | Nystuen | 340/244 |
| 3,804,300 | 4/1974 | Cox | 222/135 |
| 3,826,113 | 7/1974 | Boraas et al. | 68/12 R |
| 3,877,682 | 4/1975 | Moss | 259/7 |
| 3,896,827 | 7/1975 | Robinson | 134/10 |
| 3,898,861 | 8/1975 | McMillin | 222/145 |
| 3,951,311 | 4/1976 | Johansson | 222/145 |
| 3,960,295 | 6/1976 | Horak | 222/145 |
| 4,060,178 | 11/1977 | Miller | 222/14 |
| 4,084,237 | 4/1978 | Beachman | 364/400 |
| 4,090,475 | 5/1978 | Kwan | 222/70 |
| 4,285,445 | 8/1981 | Vander Molen et al. | 222/49 |
| 4,512,764 | 4/1985 | Wunsch | 604/80 |
| 4,556,011 | 12/1985 | Tarr | 118/46 |

FOREIGN PATENT DOCUMENTS

| | | |
|---|---|---|
| 1703804 | 3/1972 | Fed. Rep. of Germany . |
| 2244859 | 4/1975 | France . |
| 1130568 | 10/1968 | United Kingdom . |
| 1192442 | 5/1970 | United Kingdom . |

*Primary Examiner*—H. Grant Skaggs

*Attorney, Agent, or Firm*—Donald M. Sell; Walter N. Kirn; David W. Anderson

[57] ABSTRACT

Mixing concentrates requires the precise dispensing of predetermined amounts of concentrate into predetermined amounts of liquid and such mixes can be obtained by the use of a system having two positive displacement pumps, one for pumping larger volumes with each operation than the second pump and a pressure regulator to maintain a predetermined pressure on the solvent carrier fluid for the mixture.

2 Claims, 2 Drawing Sheets

MIXING SYSTEM FOR USE WITH CONCENTRATED LIQUIDS

BACKGROUND OF THE INVENTION

1. Field of the Invention

This invention relates to a closed system in which predetermined amounts of concentrate are mixed with the carrier liquid to produce a solution, and in one aspect, to a system for mixing predetermined amounts of toxic concentrates of chemicals with water to provide a solution meeting specifications for janitorial services.

2. Description of the Prior Art

Systems for delivering different additive fluids in controlled amounts to equipment utilizing those fluids, such as laundry or dishwashing equipment, are known. Such systems include the use of pumps and valves to automatically feed the additive fluid into the carrier liquid to provide a solution for performing the washing or rinsing function in the equipment. One such patent is U.S. Pat. No. 4,090,475, which discloses an apparatus to deliver a laundry system or dishwashing system different liquid detergents, soaps, water softeners, bleach, or other additive liquids or solutions and comprises a system wherein a pump is used for delivering a plurality of different additive fluids to the equipment, which valves are operated in a timed sequence during the operation of the pump to allow the additive fluid to enter the carrier fluid and then the pump operates to pump the flushing liquid through the chamber to flush the chamber and pump. The injection valves and flushing equipment are controlled by a number of different timers interconnected to operate the respective valves sequentially through predetermined intervals. Even positive displacement pumps operating with solenoid valves for predetermined intervals cannot give accurate measured amounts of the additive fluid or a measured amount of carrier liquid since changes in the line voltage of the power source to the solenoid valves and to the pump and changes in pressure in the line for the flushing water cause a variation in the timing cycle during operation of the system and in the composition of the solution supplied to the equipment. Other systems for supplying chemicals to laundry or dishwashing equipment, such as illustrated in U.S. Pat. No. 3,826,113, use a series of pumps, one connected to each fluid product, and an electrical timing network for the system which further compounds the chance for error.

It is therefore important to such systems that the pressure on the water supply and the amount of additive fluid be precise as possible to provide the proper amount of solution at the proper strength.

Accuracy as to the amount of additive fluid and the amount of carrier fluid is particularly important when the strength of the solution is important to obtain the result desired. Therefore, it is important that the system be free of any influence from environmental changes on what the resulting solution will be.

SUMMARY OF THE INVENTION

The present invention provides a system and method for dispensing predetermined quantities of concentrated fluids with predetermined amounts of solvent or carrier liquid, such as water, to produce a solution meeting defined specifications. The present fluid mixing system comprises a mixing manifold with a passageway filled with carrier fluid, i.e., water, and which is connected to a first positive displacement pump for moving a first predetermined volume of fluid during each cycle and via valve means to a second positive displacement pump having a predetermined second and smaller capacity on each cycle. The pumps serve to discharge predetermined amounts of carrier fluid from the manifold when a valve is opened to draw an equal amount of concentrate into the manifold. A source of carrier fluid or water is connected to a pressure regulator to regulate the pressure on the water as it enters the mixing manifold, through valve means, or as it enters an output manifold such that in a given cycle a given amount of water discharged. The operation of the pumps is responsive to the selected quantity of additive fluids or concentrates to be used in making a given solution. The pumps displace water and draw the concentrate into the manifold. The solution has the proper strength by the use of the pressure regulator on the carrier fluid line, such that when the valve is open to draw carrier fluid into the mixing manifold or a second output manifold, a predetermined amount of carrier fluid will be discharged.

Without the combination of the two pumps it may require a longer than necessary period of time to dispense some predetermined measured quantity of concentrate into the closed system for dispensing the concentrate. The pressure regulator on the carrier fluid makes it possible to dispense through the system predetermined measured amounts of fluid since the pressure in the pressure regulator maintains the fluid at a predetermined pressure even though the normal pressure from the supply of such product is other than normal line pressure.

The system of the present invention thus provides a new method of mixing predetermined amounts of concentrate with predetermined amounts of carrier liquid in that the system will displace from the closed mixing chamber a predetermined amount of carrier fluid to draw into the chamber a predetermined amount of concentrate. The concentrate is then flushed from the chamber by a predetermined quantity of carrier fluid. A second predetermined amount of carrier fluid is dispensed from the chamber to bring in a second predetermined amount of concentrate by operating a second positive displacement pump through a predetermined number of cycles. The concentrate is again displaced from the chamber by a predetermined amount of carrier fluid being flushed through the manifold to discharge the concentrates and purge the system of any remaining concentrates and add to the discharge a measured amount of the carrier fluid.

BRIEF DESCRIPTION OF THE DRAWINGS

The following description of the present invention will refer to the accompanying drawing wherein.

DESCRIPTION OF THE PREFERRED EMBODIMENT

The mixing system of the present invention is adapted for use in mixing with a solvent or carrier fluid, such as water, concentrates of chemicals which are used in performing certain janitorial services. Such concentrates may include detergents, ammonia, disinfectants, degreasers, and deodorizers such that solutions may be mixed up by the janitorial staff to carry out the tasks prescribed. It is important that the solutions with which these tasks are performed have the proper amount of additive fluids therein such that the labor used is well spent in that the solution that they are working with performs the required task. Thus, the mixing device of the present invention will assure the prescribed solution is dispensed from the system at the proper mixture when selected from a control board mounted on the system.

The mixing system can be either wall or cart mounted and is adapted to be connected through a normal hose connection 10 to a source of hot or cold water or both. The solution is dispensed from the system through a dispensing tube 11, preferably formed of a clear plastic and the end of the dispensing tube may be placed in a bucket, bottle, or directed to a machine of the user's choice.

Figure 1:
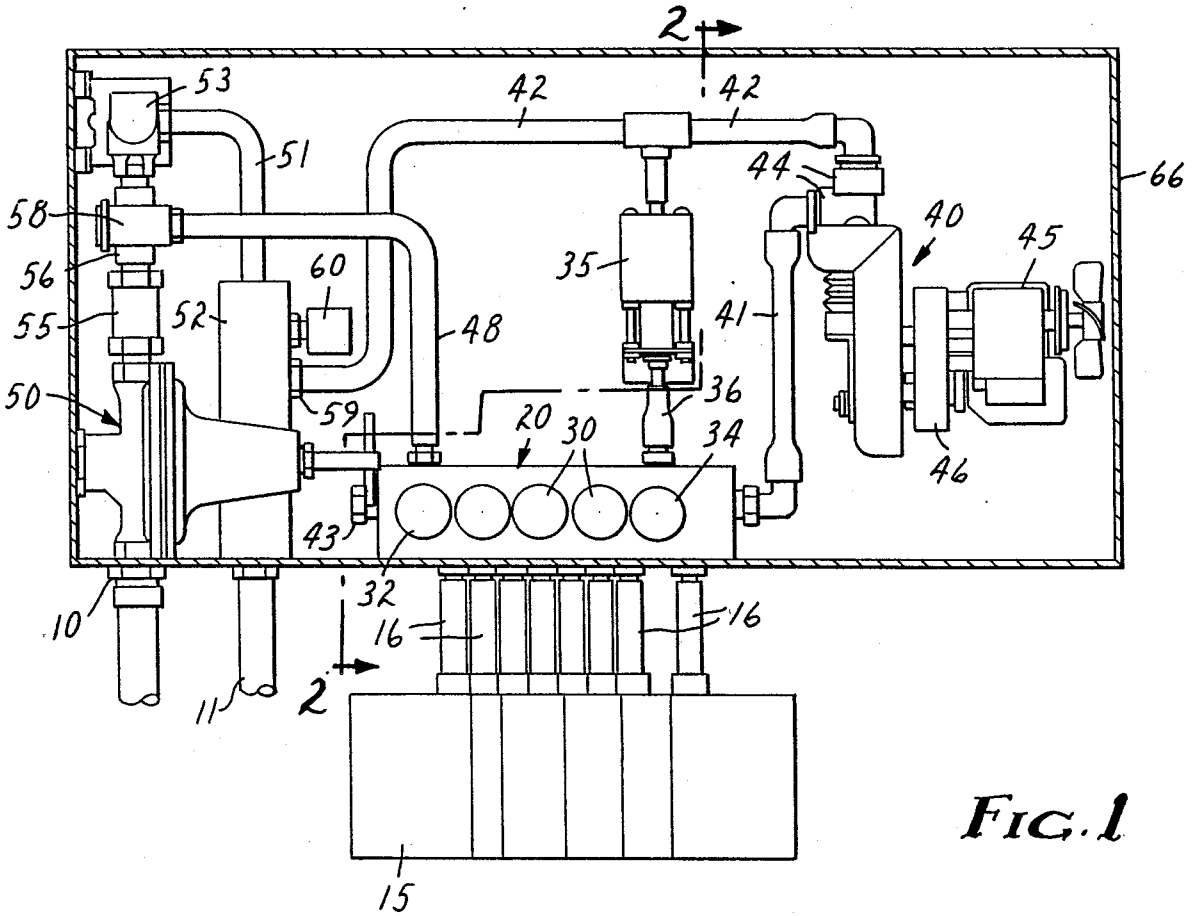
FIG. 1 is a schematic layout of the mixing system of the present invention.
Figure 2:
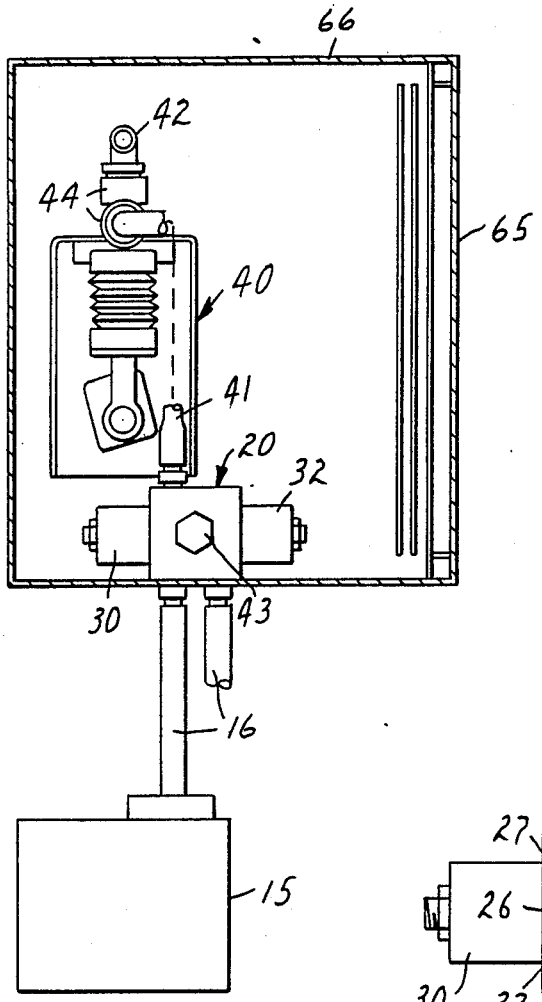
FIG. 2 is a vertical sectional view taken along line 2—2 of FIG. 1.
Figure 3:
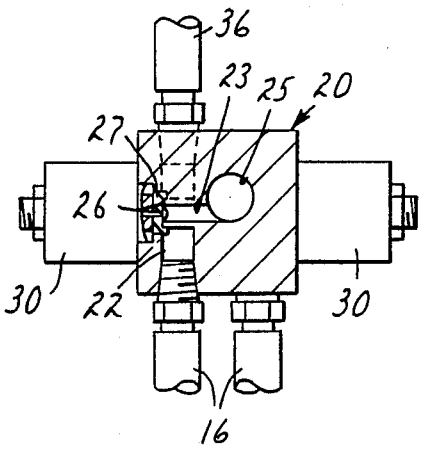
FIG. 3 is a vertical sectional view of the mixing manifold.

As illustrated, the system is adapted for use with eight reservoirs in the form of bottles 15 of concentrates which are placed beneath the system and connected to the mixing system through intake tubes 16 which extend from hose fittings mounted on a manifold 20. Associated with each of the tubes 16 is an inlet port 22 in the manifold 20, see FIG. 3. Each inlet port 22 communicates with a transverse passsageway 23 which communicates with a main bore 25 extending entirely through the manifold 20. The inlet ports 22 are staggered on the left and right sides of the main bore 25 to reduce the size of the manifold. A valve seat 26 and valve 27 control the flow of fluid from the inlet ports to the passageway 23 and the main bore 25. Each valve 27 is controlled by a solenoid 30 to rapidly move the valve 27 between open and close position. Each solenoid actuated valve 30 controls which concentrate can be drawn from a bottle 15 into the manifold 20. The manifold 20 is also provided with a solenoid controlled valve 32 which will allow the intake of carrier fluid or water from the source thereof. Additionally, a solenoid controlled valve 34 is provided to regulate the discharge of fluid from the main bore 25 via tube 36 to a positive displacement pump 35 which has an adjustable stroke in the range of 0.05 ml to 1.50 ml per cycle. One end of the manifold main bore 25 is connected to a positive displacement pump 40, via line 41, which pump can dispense a predetermined measured amount of material from the mixing manifold 20 with each cycle of operation. As illustrated, the pump 40 is a bellows pump with a positive displacement of 10 ml per cycle. Poppet valves 44 in the pump 40 at the inlet from line 41 and at the outlet to a line 42 prevent backflow of fluid through the pump 40. The pump 40 is driven by an electric motor 45 to control, through a reduction gear 46, the cycles of the pump 40, illustrated in FIG. 2, as being at the midpoint of a cycle drawing 10 ml of concentrate from a bottle 15 into the main bore 25. The other end of the main bore 25 is blocked to seal the same as by a plug 43.

The carrier fluid is maintained at a predetermined pressure at the time it is introduced into the manifold through the solenoid valve 32 via inlet tube 48. This pressure is maintained by a pressure regulator 50 provided within the dispensing system which is attached to hot and/or cold water supply by means of the connector 10. The regulator 50 maintains the carrier fluid pressure at a pressure lower than that normally available from the supply of such carrier fluid. Under such conditions, variations in the normal pressure of the carrier fluid at the source will not effect the amount of fluid moving from the pressure regulator into the mixing manifold 20 or direct to a discharge manifold 52 via a solenoid operated valve 53. The pressure regulator 50 is attached to a check valve 55 which is then connected to a cross 56. The cross 56 contains a water pressure switch 58 which prevents operation of the dispensing system when the water pressure falls below a preset value which is somewhat less than the preset value of the pressure regulator 50. The cross 56 also attaches to the flush line 51 via the solenoid valve 53. The combination of the regulator 50 and the positive displacement pumps of the apparatus within the mixing system provides for mixing proper proportions of the concentrates and carrier fluid and provides a constant output of the selected solution.

The output manifold 52 contains a chemical inlet connection 59, leading from the pump 35 and pump 40, and a check valve 60 which allows the ingress of only air into the output manifold 52 to assure the complete emptying of the contents thereof. The contents are discharged from the output manifold 52 through the outlet tube 11 directed to the receptor for the mixed solutions.

In operation, the operator selects a prescribed solution to be mixed and the quantity and activates the proper buttons on the front panel 65 of the device enclosing the front of a hollow rectangular frame 66 enclosing the mixing system. The operating panel 65 is connected to one or more circuit boards which are programmed as by microchips or other electronics to control operation of the device. The types of solutions made are degreasing cleaners, general purpose cleaners, bowl cleaner, glass cleaner, disinfectant, sanitizer, rug shampoo or wax stripper. The volumes run from 470 ml to 95 liters. The apparatus will then perform the necessary cycle of operation to dispense the selected solution at the proper strength with the designated concentrates. This is accomplished for 4 liters of Glass Cleaner by pump 40 first operating through 10 cycles to draw 100 ml of Concentrate A from a container 15 into the mixing manifold by energizing motor 45 and a solenoid valve 30 corresponding to the proper reservoir 15. The motor 45 stops the pump when 10 cycles are completed and the solenoid valve 30 closes. Valve 32 is then opened, allowing water to flow through the manifold main bore 25 for 10 seconds. This delivers 125 ml of water. The water will wash the Concentrate A from the manifold 20 through poppet valves 44 into the discharge line 42 directed to the outlet manifold 52. Pump 35 is preset to dispense 0.6 ml per cycle. It is operated, upon the prior opening of solenoid valve 34 and of a solenoid valve 30, through 12 cycles to draw in 7.2 ml of Concentrate B into central bore. Again, the solenoid valve 30 closes at the end of the 12 cycles and solenoid valve 32 is opened allowing water into the manifold, and pump 35 continues to operate until 125 ml of water is passed through the central bore 25, pump 35 and line 41 and through valves 44 to carry the Concentrate B from the central bore into the outlet conduit 42 to the discharge manifold. Valve 32 and valve 34 then close and pump 35 stops.

Additional water must be added and that is afforded by opening solenoid valve 53, directing additional water from the regulator to and through the output manifold 52. After a predetermined amount of time at a pressure of 830 Pa (gauge) the valve 53 is closed as 3.64 liters are allowed to pass to the output manifold. The solution is now dispensed and may require additional mixing.

In the device illustrated, the pump 35 corresponds to the electromagnetic pump disclosed in U.S. Pat. No. 3,601,509, and available from Valcor Engineering Corp. of Milwaukee, Wis., and identified as Model 5P 84-7B. The bellows pump 40 is preferably a Model EX 191-191-316 pump, available from Gorman-Rupp Industries of Bellville, Ohio.

The pressure regulator is a Model ⅜ 215 MIO-2O, adjusted at a pressure of 830 Pa. The regulator 50 is available from Watts Regulator of Lawrence, Mass.

Having described the invention with reference to a preferred embodiment, it will be understood that changes and modifications can be made without departing from the spirit and scope of the invention as claimed.

I claim:

1. A fluid dispensing system for dispensing a solution comprising a predetermined amount of a concentrate together with a carrier fluid, said system comprising a closed manifold chamber for storing a quantity of carrier fluid, a plurality of ports leading to said manifold chamber, each of said ports being connected by a valve to said manifold chamber and being connected to a supply of concentrate, a first positive displacement pump connected to said chamber and operable upon each cycle of said pump to displace from said manifold chamber a predetermined volume of said carrier fluid and to replace it with an equal volume of concentrate;

a second positive displacement pump connected to said manifold chamber for pumping a second predetermined volume of fluid from said manifold chamber during each cycle, which second predetermined volume is different from that of said first pump during each cycle of operation;

a pressure regulator, said pressure regulator being adapted for connection to a source of carrier fluid and means for connecting said pressure regulator to said manifold chamber, said means including a valve for controlling the flow of fluid from said pressure regulator to said manifold chamber;

whereby, operation of said first pump and said second pump will draw predetermined amounts of concentrate through said ports into said manifold chamber and a predetermined amount of carrier fluid may be dispensed through said manifold chamber.

2. A fluid dispensing system according to claim 1 wherein said system comprises an output manifold having a passageway connected to receive discharge from said first pump and from said second pump and carrier fluid direct from said regulator.

* * * * *